US005716250A

United States Patent [19]

Garofalo

[11] Patent Number: 5,716,250

[45] Date of Patent: Feb. 10, 1998

[54] SWIMMING FLIPPER

[75] Inventor: Giovanni Garofalo, Rapallo, Italy

[73] Assignee: HTM Sport S.p.A., Italy

[21] Appl. No.: 832,563

[22] Filed: Apr. 2, 1997

[30] Foreign Application Priority Data

May 3, 1996 [IT] Italy ..... GE96A0041

[51] Int. Cl.[6] ..... A63B 31/08

[52] U.S. Cl. ..... 441/64

[58] Field of Search ..... 441/61–64

[56] References Cited

U.S. PATENT DOCUMENTS 5,041,039 8/1991 Chang .
5,527,196 6/1996 Harkins ..... 441/64

FOREIGN PATENT DOCUMENTS

0572853 A1 12/1993 European Pat. Off. .
2128096 4/1984 United Kingdom .

*Primary Examiner*—Jesus D. Sotelo
*Attorney, Agent, or Firm*—Larson and Taylor

[57] ABSTRACT

Swimming flipper comprising a fin blade made of rigid material and a shoe made of soft material similar to rubber, said fin blade and said shoe being interconnected by mechanical means of joining and locking, and an insole element which can be inserted inside the shoe itself. Said locking means extend from said insole to said fin blade or vice versa, through the part of the sole of the shoe interposed between said insole and the fin blade portion underneath.

7 Claims, 2 Drawing Sheets

SWIMMING FLIPPER

BACKGROUND OF THE INVENTION

The present invention relates to a swimming flipper in which the various elements constituting the flipper, in other words the shoe for accommodating the foot of the user and the fin blade, can be put together and assembled in relation to one another in an easily mountable and demountable manner.

In particular, the present invention relates to flippers for swimming in which the fin of considerable lightness is made of very rigid material, for example fibreglass or the like, and is coupled to the shoe by means of a mechanical coupling.

DESCRIPTION OF RELATED ART

It is known that specific swimming flippers exist for each type of marine use. For example, special flippers for divers using self-contained underwater breathing apparatuses, the fin blade of which is shaped so as to give adequate thrust for the weight to be moved. The rigidity of the fin blade varies in the different models of flipper according to the power which the diver is capable of developing with his legs and the sea conditions which the diver himself will face.

In general, depending on the extent of swimming ability and experience of the user, the various models of flipper differ from one another in shape, size and materials of the fin blade and in general in the flipper itself as a whole. In the models in which the fin blade of the flipper requires considerable rigidity, the shoe for the foot is made of a different material, the two parts, fin and shoe, being joined together in a permanent manner.

In these models, therefore, the necessity of changing flipper type in different situations and conditions is clear, in cases where the user is either an expert or essentially inexperienced.

French Patent no. 7536093 (Dessault) shows that the use is known of fins blades which are interchangeable inside shoes which have two lateral guides in which the fin blade is inserted and subsequently locked by means of screws. According to this solution, the fin blade, which is subjected to continuous stresses, can come out of the guides laterally. Furthermore, the fixing screws are inserted directly into the shoe made of semi-soft material; this involves the necessity of making the sole of the shoe itself of a considerable thickness, which sometimes involves an anomalous positioning of the foot inside it.

SUMMARY OF THE INVENTION

The aim of the present invention is to eliminate the abovementioned and other disadvantages.

More specifically, the aim of the present invention is to make a modular swimming flipper which is capable of being adapted, in its various configurations, to the requirements of the user, to the sea conditions and in general to any specific type of use of the flipper itself.

A further aim of the present invention is to propose a modular swimming flipper with characteristics of considerable resistance and reliability in time, which can be made easily and economically.

These and other aims specified below are achieved by the modular swimming flipper forming the object of the present invention, which comprises a fin blade made of rigid material and a shoe made of soft material similar to rubber, said fin blade and said shoe being interconnected by mechanical means of joining and locking, characterized in that it comprises an insole element which can be inserted inside the shoe itself, and in which said locking means extend between said insole and said fin blade, through the part of the sole of the shoe interposed between said insole and the fin blade portion underneath.

BRIEF DESCRIPTION OF THE DRAWINGS

These and other characteristics of the swimming flipper according to the invention will be better shown in the detailed description which follows and is made with reference to the figures of the attached drawings, which show some non-limiting embodiments of the invention and in which.

DESCRIPTION OF THE PREFERRED EMBODIMENTS

Figure 1:
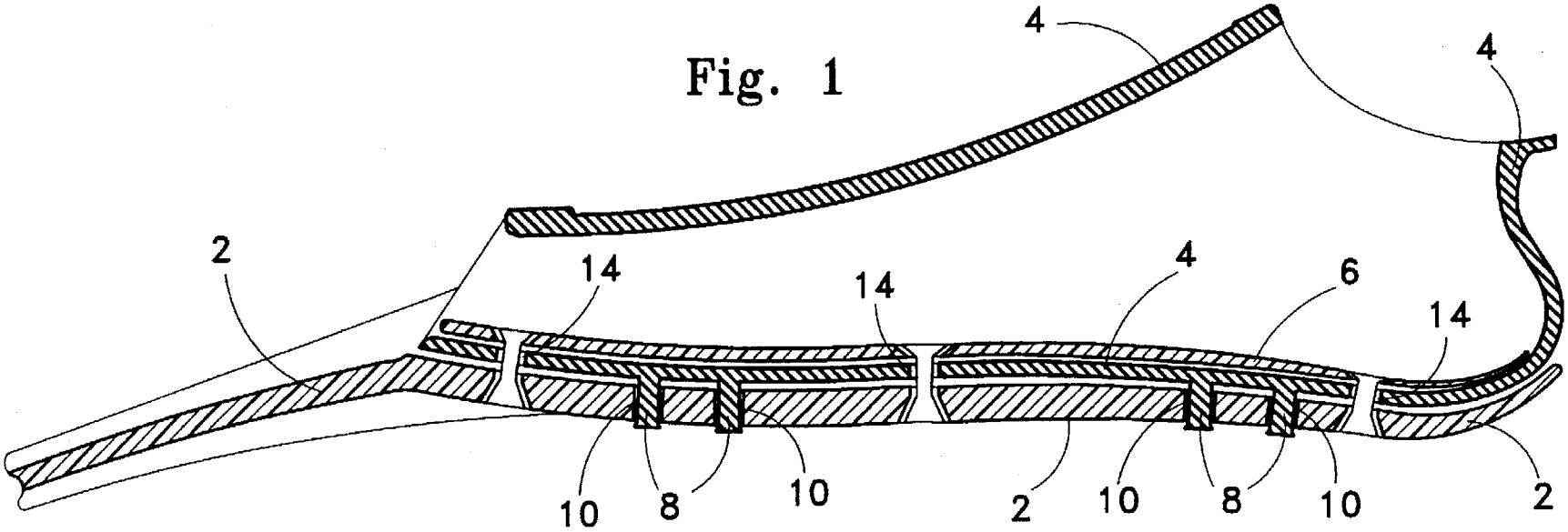
FIG. 1 shows diagrammatically, in a longitudinal section, the flipper forming the object of the present invention with the shoe of completely closed type.
Figure 2:
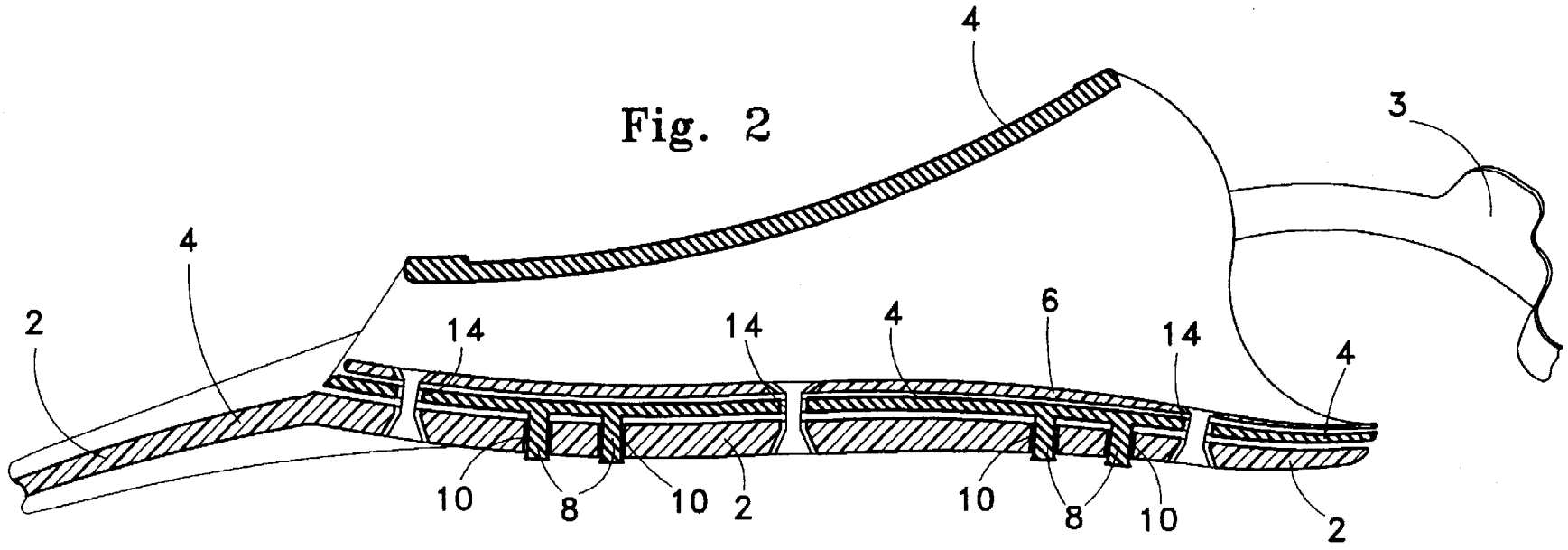
FIG. 2 shows diagrammatically, in a longitudinal section, the flipper forming the object of the present invention with the shoe partially open at the rear and with a fastening strap.

With reference to FIGS. 1 and 2, the swimming flipper according to the present invention comprises a fin blade 2, a shoe 4 and an insole 6 which can be assembled to one another. The fin blade 2 and the insole 6 are generally made of polypropylene or another material having greater rigidity characteristics than the shoe 6 which is made of elastomeric material.

The shoe 4, of the completely closed type or the partially open type with rear fastening strap 3, is provided, in its lower part, with essentially cylindrical protuberances 8 which are inserted in corresponding through-holes 10 present in the fin blade 2. Said protuberances 8 and said holes 10 can be arranged in various configurations which, however, are all suitable for accurately positioning the shoe 4 on the fin blade 2.

According to the present invention, the insole 6 is inserted inside the shoe 4 and has means for locking the shoe between it and the fin blade 2 underneath.

Figure 3:
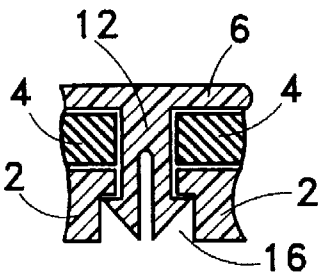
FIG. 3 shows diagrammatically, in section, a detail of the flipper comprising the means of assembly of the flipper itself, according to an embodiment of the present invention.

In particular in FIG. 3, a constructive solution for said means is shown, in which there are formed on the insole 6, in one piece with it, pins 12 which are inserted in through-holes 14 of the shoe 4 and are locked elastically in the fin blade 2 in a suitable holed and shaped seat 16.

Figure 4:
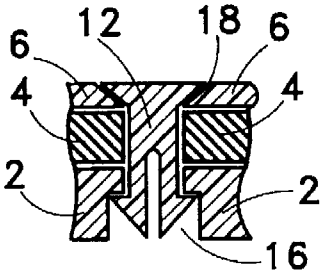
FIG. 4 shows diagrammatically, in section, a detail of the flipper comprising the means of assembly of the flipper itself, according to a further embodiment of the present invention.

FIG. 4 shows a further constructive solution, in which the pins 12 are separate from the insole 6 and are inserted in through-holes 18 present therein; in a similar manner to FIG.

3, these pins are inserted in the through-holes 14 of the shoe 4 and are locked elastically in the fin blade 2 in the shaped seat 16.

Figure 5:
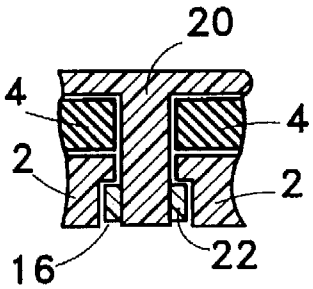
FIG. 5 shows diagrammatically, in section, a detail of the flipper comprising the means of assembly of the flipper itself, according to a further embodiment of the present invention.

FIG. 5 shows a further embodiment for said means, in which there are formed on the insole 6, in one piece with it, threaded pins 20 which are inserted in said through-holes 14 of the shoe 4 and are locked at the bottom of the fin blade 2, in the holed seat 16, by means of corresponding nuts 22.

Figure 6:
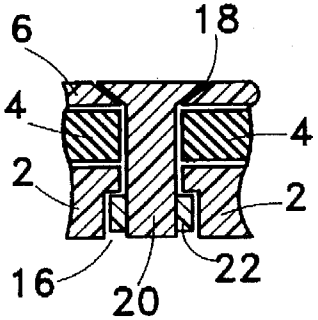
FIG. 6 shows diagrammatically, in section, a detail of the flipper comprising the means of assembly of the flipper itself, according to a further embodiment of the present invention.

FIG. 6 shows a further constructive solution, in which the pins 20 are separate from the insole 6 and are inserted in the through-holes 18 present therein; in a similar manner to FIG. 5, these pins are inserted in the through-holes 14 of the shoe 4 and are locked at the bottom of the fin blade 2 in the holed seat 16.

The use of the modular swimming flipper forming the object of the present invention is evident from the preceding structural description of the same. In fact, once the choice of the type of fin blade to be used has been made and once the most comfortable shoe has been tried, it is possible to assemble the flipper.

The insole 6 is inserted inside the shoe 4 and both are put on the fin blade. The protuberances 8 present under the shoe are inserted in the holes 10 of the fin blade, accurately positioning all the parts, and, by means of the pins, provided separately or formed in one piece with the insole according to the model available, the shoe 4 is locked on the fin blade 2, obtaining the flipper in its operational configuration.

The advantages already cited are illustrated better by the preceding detailed description of the structural and functional characteristics of the modular swimming flipper forming the object of the present invention.

The flipper is capable of being adapted, in its various configurations, to the requirements of the user, to the sea conditions and in general to any specific type of use of the flipper itself. In fact, it is possible to choose different fins blades with the same shoe. Or shoes of different size can be associated with the same fin blade so that the same flipper can used by people with different shoe sizes.

Furthermore, the insole made of semi-rigid material guarantees a robust coupling between the shoe and the fin; the pins are present in suitable number and position to guarantee said coupling.

Finally, the protuberances arranged at the bottom of the shoe bring about a form of sculpturing for the sole of the flipper as a whole, constituting a non-slip element. The position of the sculpturing, in addition to bringing about the correct position of the shoe, can also impart an aesthetic value to the flippers themselves.

I claim:

1. A swimming flipper comprising a fin blade made of rigid material and a shoe made of soft material similar to rubber, said fin blade and said shoe being interconnected by mechanical means of joining and locking, further comprising an insole element which can be inserted inside the shoe itself, and in which said locking means extend between said insole and said fin blade, through the part of the sole of the shoe interposed between said insole and the fin blade portion underneath.

2. The swimming flipper according to claim 1, in which said shoe is provided, in its lower part, with a plurality of essentially cylindrical protuberances which are inserted in corresponding through-holes formed in the fin blade, said protuberances and said holes being arranged suitably for accurately positioning the shoe on the fin blade.

3. The swimming flipper according to claim 2, in which said protuberances project at the bottom from the lower surface of the fin blade, constituting a non-slip sole element for the flipper.

4. The swimming flipper according to claim 1, characterized in that said locking means comprise pins, formed in one piece on the insole, which are inserted in through-holes of the shoe and are locked elastically in the fin blade in a holed and shaped seat.

5. The swimming flipper according to claim 1, in which said locking means comprise pins which are inserted in through-holes present in the insole and are inserted subsequently in the through-holes of the shoe and are locked elastically in the fin blade in the shaped seat.

6. The swimming flipper according to claim 1, in which said locking means comprise threaded pins, formed in one piece on the insole, which are inserted in said through-holes of the shoe and are locked at the bottom of the fin blade, in the holed seat, by means of corresponding nuts.

7. The swimming flipper according to claim 1, in which said locking means comprise threaded pins which are inserted in the through-holes present in the insole and are inserted subsequently in the through-holes of the shoe and are locked at the bottom of the fin blade in the holed seat.

* * * * *